United States Patent [19]

Bollinger

[11] Patent Number: 4,955,146

[45] Date of Patent: Sep. 11, 1990

[54] LUMBER DRYING KILN

[75] Inventor: Howard E. Bollinger, Lenoir, N.C.

[73] Assignee: Boldesigns, Inc., Lenoir, N.C.

[21] Appl. No.: 239,549

[22] Filed: Sep. 1, 1988

[51] Int. Cl.[5] ..... F26B 21/06

[52] U.S. Cl. ..... 34/191; 34/225; 34/219

[58] Field of Search ..... 34/191, 193, 202, 218, 34/219, 212, 225, 231

[56] References Cited

U.S. PATENT DOCUMENTS

| | | | |
|---|---|---|---|
| 1,539,817 | 5/1925 | Thelen | 34/191 |
| 2,718,713 | 9/1955 | Bloxham | 34/231 |
| 3,070,896 | 1/1963 | Knudson et al. | 34/219 |
| 3,659,352 | 5/1972 | Look | 34/191 |

*Primary Examiner*—Henry A. Bennett
*Assistant Examiner*—John Sollecito
*Attorney, Agent, or Firm*—Rhodes, Coats & Bennett

[57] ABSTRACT

An improved kiln for seasoning lumber. The kiln includes an air treatment and circulating assembly adjacent the top wall. The air treatment and circulating assembly includes a series of fan assemblies for circulating air to the lumber stacked within said chamber and means for heating air within said chamber. An exhaust venting system located on the downstream side of the airflow from the lumber stack and on the upstream side of the air treatment and circulating assembly is operable to exhaust moisture-ladened wet air prior to the air passing through the air treatment and circulating system. The kiln also includes an intake air vent located downstream of the air flow from the air treatment and circulating assembly and upstream of the stacked lumber which adds additional outside air to make up that portion of air which is exhausted through the exhaust venting system.

2 Claims, 4 Drawing Sheets

LUMBER DRYING KILN

CROSS-REFERENCE TO RELATED APPLICATION

This application deals with subject matter which was disclosed in U.S. application Ser. No. 06/671,324 filed Nov. 14, 1984, now abandoned.

BACKGROUND OF THE INVENTION (1) Field of Invention

The present invention related generally to improvements in the design of forced circulation kilns or chambers for drying and, in particular, to kilns for conditioning or seasoning lumber or similar material.

(2) Description of the Prior Art

Newly cut lumber contains varying amounts of moisture which may range from 30% to more than 200% by weight depending on the species of the wood and other factors. The dimensions of the cut wood, as well as its strength, will vary as a function of the moisture content. Thus, in order to ensure greater dimensional stability and strength, as well as lower shipping costs, it is necessary to reduce the moisture content of the cut wood.

Removal of the moisture from the cut wood is usually referred to as curing. The two commonly used methods of curing are known as the kiln-dry method and the air-dry plus kiln-dry method. The primary difference between the two methods is the air-dry plus kiln-dry method includes the additional steps of first arranging the lumber on elevated racks in open yards to take advantage of the moisture removing capacity of the natural atmosphere. Depending on the type of wood, method of stacking, and other environmental conditions, between 40 and 300 days may be necessary to reduce the moisture content to 20%.

The kiln-dry method may be used with or without the air-dry pre-drying step. The lumber is tiered upon racks or kiln trucks and placed in the kiln where the dry bulb temperature and the wet bulb temperature of the surrounding air are maintained at various predetermined conditions and according to published schedules to reduce the moisture content to an amount near that desired in final use. Typically, the desired moisture content is between 6 and 10%.

While kiln-drying is significantly more rapid and more controllable than simple air-drying, it adds significantly to the cost of the cured lumber. A conventional lumber drying kiln is both costly to construct and to operate. First, the conventional lumber-drying kiln must be large enough to accomodate large amounts of stacked lumber. Second, the walls of the kiln must be insulated in order to prevent excessive heat loss. Finally, electricity for the large capacity fans, steam for heating the air in the kiln, and high maintenance costs due to the moisture-laden atmosphere of the kiln result in high operating costs.

One example of such a well-known conventional kiln is shown in U.S. Pat. No. 3,131,034 to Marsh. Such kilns are usually provided with two or more longitudinal rows of vents which serve to alternately admit air to the kiln and to exhaust the kiln atmosphere depending on the direction of the fan rotation within the kiln. Each of these vents usually includes a body member aligned to a complementary metal opening in the top of the kiln. The upper portion of the body member is hingedly connected to a vent cap having operating arms which are actuated in response to the direction of the fan operation. Thus, in operation, outside air is brought in on the inlet side of the fan assembly and blown through the heating elements, then a portion of the heated air is exhausted out of the exhaust vent while the larger portion of the air passes around and through the stacked lumber.

Certain disadvantages become apparent with such a design. Firstly, a significant amount of treated air passes through the steam heaters and is then exhausted through the outlet vents. Secondly, a significant portion of the total fan airflow goes out through the vents before passing through the stacked lumber. Finally, the large number of vents located in the roof adds considerably to the cost of construction.

Because of the high temperature, high humidity in the interior of the drying kiln, it has also been the practice in the past to locate the drive motor outside of the kiln proper (see Marsh esp. FIG. 1). Because the fans and the associated motors are conventionally located above the lumber stacks, it has also become the practice to construct a separate room, isolated from the drying chamber, which may house the motor and associated controls. One example of such a separate control room is shown in U.S. Pat. No. 4,098,008, issued to Schuette et al (see esp. FIG. 4).

Certain disadvantages become apparent with such a design. First, a completely separate structure must be constructed adjacent to the drying kiln which adds significantly to the cost of the drying kiln. Second, the drive shaft between the fans and motor must be significantly lengthened to reach the secondary building. This adds to the construction cost, maintenance, and probability of damage due to the higher vibration of the longer drive shaft. As a result, this design has not been well received by the industry.

Finally, in the past during the construction of kilns, each kiln has been custom designed and fabricated. As such, once the construction of the housing of the kiln has progressed to a certain stage, it has been the conventional practice for the various fans, heat exchangers, humidifiers, baffles, etc. to be individually stalled prior to completing construction of the kiln. This results in a tedious and prolonged construction of the kiln such that the normal time for construction is approximately eight weeks. This has been due, in a large part, to the complicated roof designs of the previous kilns.

It has thus become desirable to develop a lumber drying kiln which will more effectively utilize the energy necessary for drying lumber. It has also become desirable to develop a lumber kiln structure which will better facilitate access to the fan motors without unnecessary costs and maintenance. Finally, it has become desirable to develop a lumber kiln structure which is particularly adaptable to prefabrication, thereby eliminating the long lead time necessary to construct present day lumber kilns.

SUMMARY OF THE INVENTION

The present invention solves the aforementioned problems associated with the prior art by providing a kiln for seasoning lumber that includes a powered exhaust venting system located on the downstream side on the airflow from the lumber stack and of the upstream side of the primary fans. The powered exhaust venting system is operable to exhaust moisture-ladened wet air prior to this air being reheated or passing through the primary fan system. An intake air vent located downstream of the flow from the primary fans and upstream of the stacked lumber is operable to add additional outside air to make up that portion of air which is exhausted by the powered exhaust vent. In addition, the present invention includes an integrally formed housing within one sidewall which serves to allow easy access to the fan motors without the need for a separate structure or longer drive shafts. Finally, since the venting system of the present invention is particuarly adaptable to being located in the opposite vertical walls, this arrangement permits the use of a ventless roof. As such, the present invention eliminates certain time-consuming operation during construction and permits the use of prefabricated materials that reduce the time for erection and construction to less than one-eighth that of conventional lumber drying kilns.

Accordingly, one aspect of the present invention is to provide an improved air-circulating and venting system for a lumber drying kiln which is more economical to construct, operate, and maintain than the prior art kilns.

Another aspect of the present invention is to provide a integrally formed housing within sidewall of the lumber drying kiln which is operable to permit easy access to the fan motor without the necessary expense and maintenance costs associated with a separate control room.

Still another aspect of the present invention is to provide a new and improved kiln design which does not require roof vents and which is particularly adaptable to simplifying construction and is economical to erect and operate.

These and other aspects of the present invention will more clearly understood after review of the following description of the preferred embodiment of the invention, when considered with the drawings.

DESCRIPTION OF THE INVENTION

Figure 1:
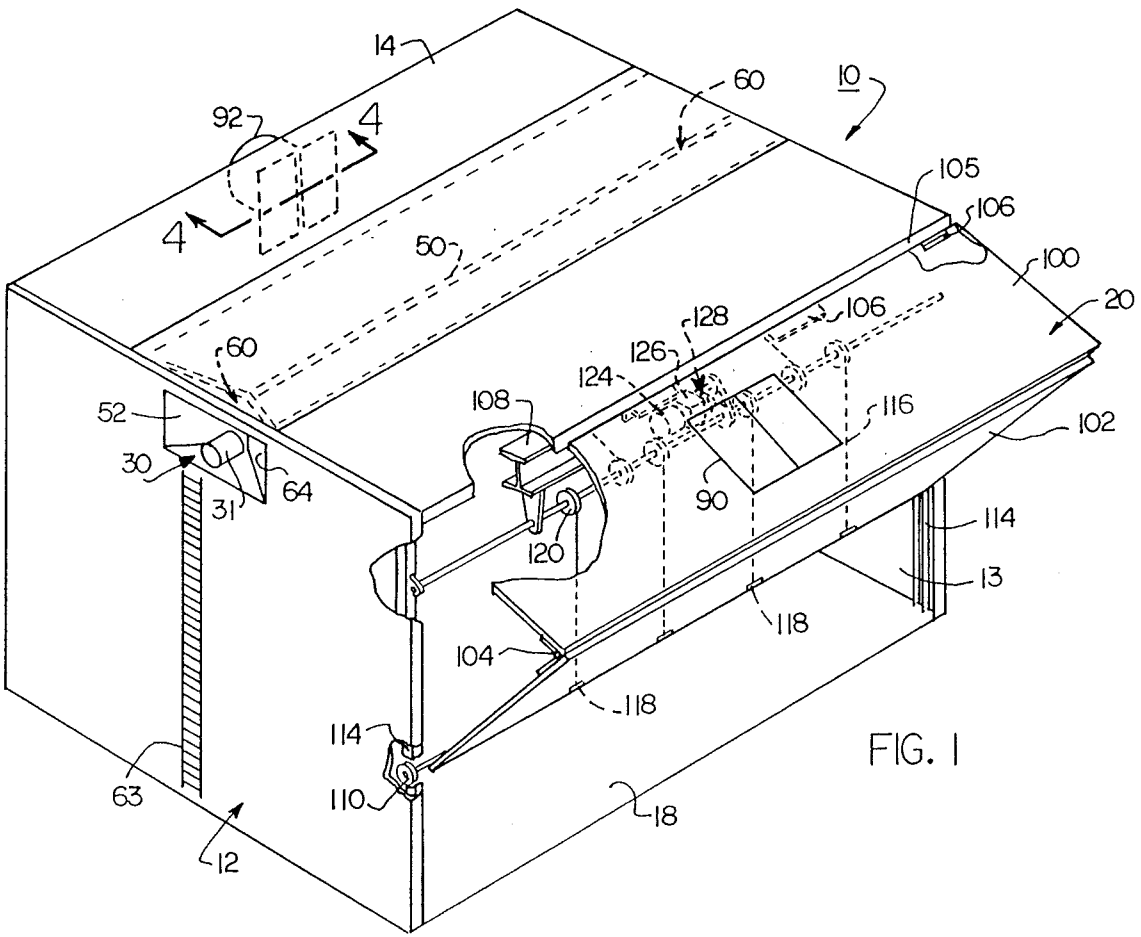
FIG. 1 is a perspective view of a kiln, constructed according to the present invention, with portions thereof removed for clarity.

Referring now to the drawings in general and to FIG. 1 in particular, it will be understood that the illustrations are for the purpose of describing the preferred embodiment of the invention and are not intended to limit the invention hereto. As best seen in FIG. 1, a drying chamber, generally designated 10, is shown utilizing the venting system of the present invention. The drying chamber 10 is of an elongated, rectangular configuration which may be of any desired size. In one embodiment, for example, the kiln may be approximately 27 feet wide, 33 feet deep, and 26 feet high. The width of the kiln is typically increased in 9 feet increments to 36′ and 45′. The chamber 10 is defined by a structure including sidewalls 12, 13, a generally flat roof 14, a rear wall 16, a floor 18, and a front enclosure assembly 20. The walls 12, 13 and 16 may be formed of brick, concrete, metal, block, etc. However, in the preferred embodiment, sidewalls 12, 13 and rear wall 16 are formed of prefabricated panels of 8′×27′ or 12′×27′. The panels are formed on tubular frames 2′×2″0 with a 0.040″ thick aluminum skin over foam insulation (not shown). The roof 14 may be of conventional construction or also may be of the tubular aluminum skin construction described above.

Figure 2:
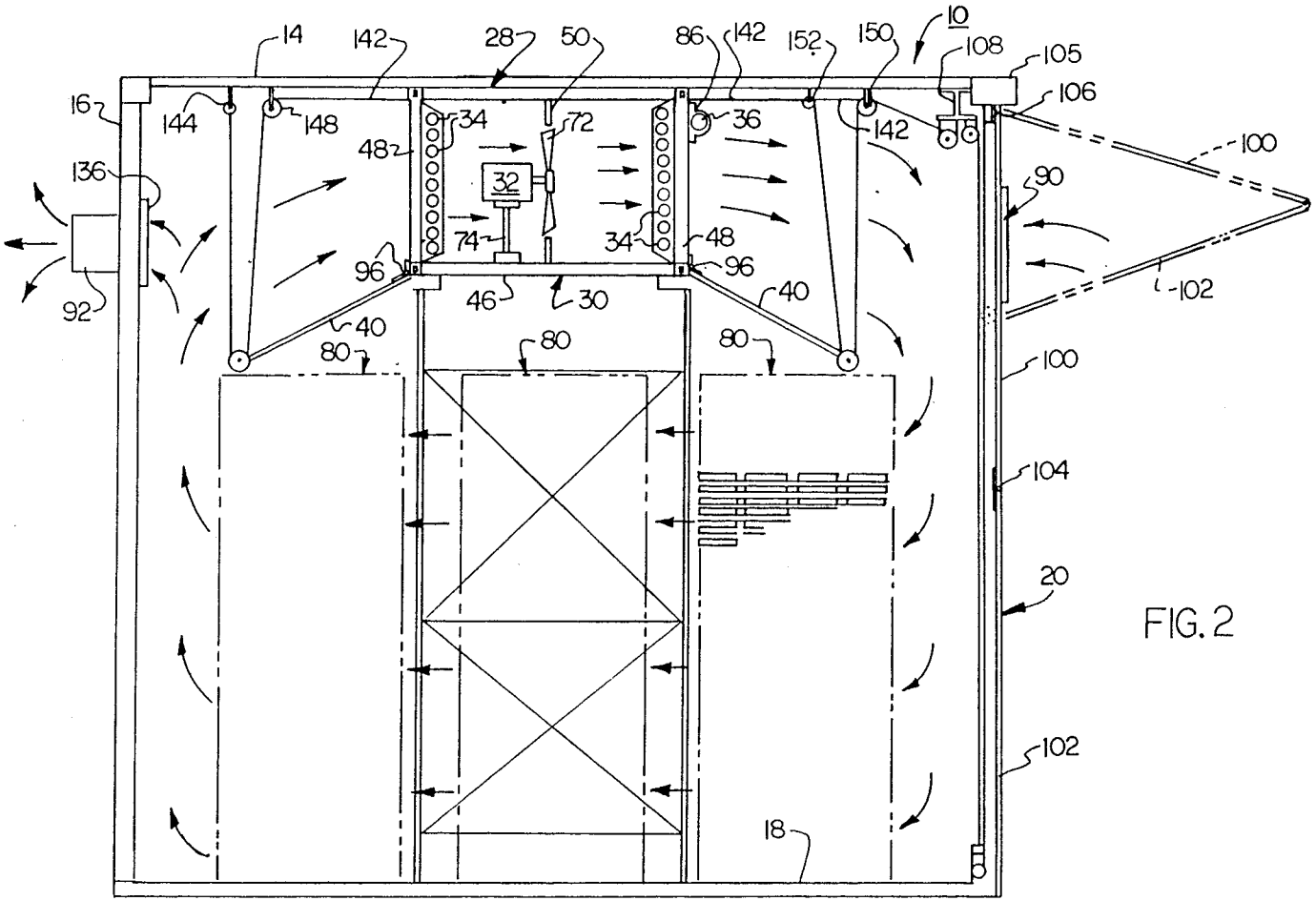
FIG. 2 is an elevational view of a kiln, as shown in FIG. 1, with portions thereof removed to illustrate various components of the air treatment, circulation, and venting systems.

As best seen in FIG. 2, the roof 14 overlies a prefabricated assembly, general designated 28. The walls, roof, and front enclosure assembly preferably are provided with appropriate insulation or heat-retaining liners as discussed above.

The prefabricated, self-enclosed assembly 28 for circulating and treating the air within the kiln chamber is positioned adjacent to the roof 14 and supported by a support frame 26 attached to the walls 12, 13 and floor 18.

The assembly includes a support structure which is attached to the support frame 26 in any suitable manner, a series of fans 32 for selectively circulating the air, coils 24 for heating the air, conduits 36 provided with a plurality of small openings therein for increasing the humidity, a deck 38, and baffle plates 40, all of which are mounted on the structure 30. Sprinklers 86 may also be mounted on the structure 30 if so desired.

Preferably the assembly 28 is prefabricated at a remote location and transported to the site. The unitized assembly then is lifted into position upon the support frame 26 which is erected upon the floor 18 sidewalls by conventional means.

Figure 3:
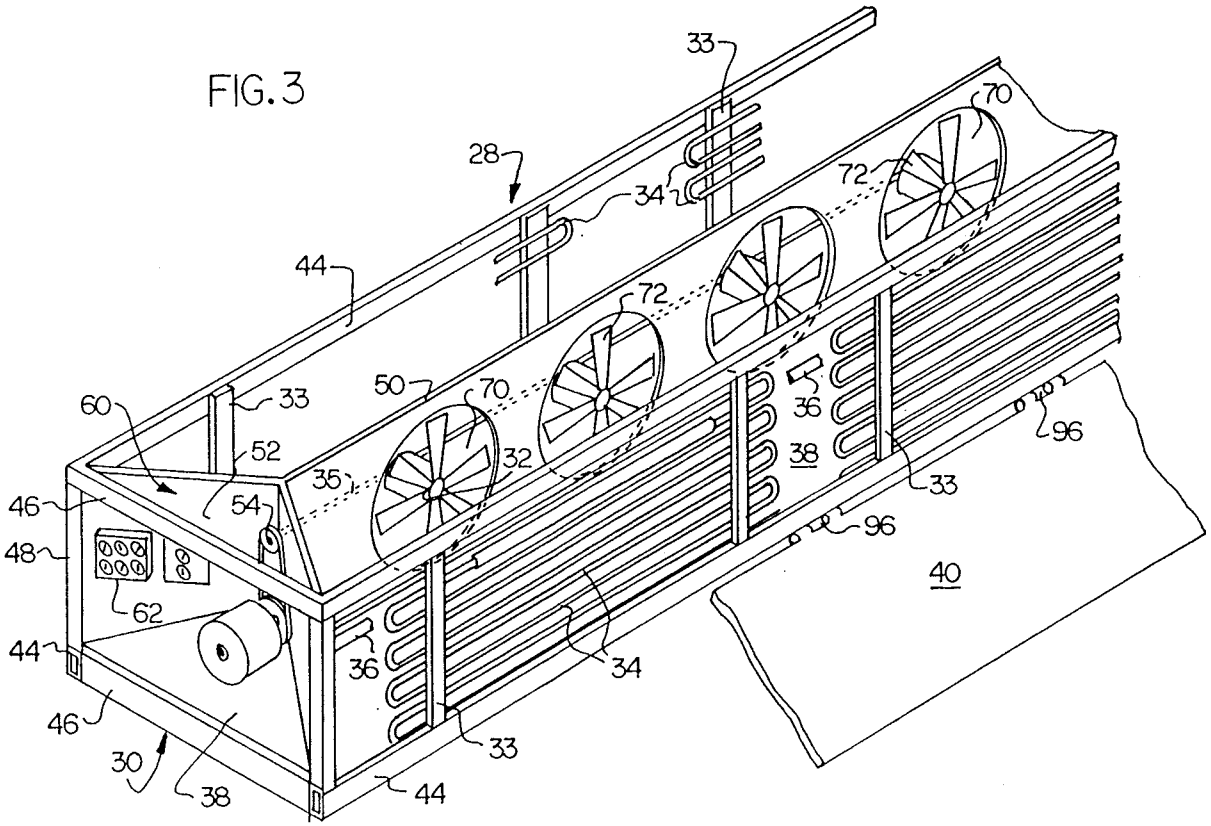
FIG. 3 is an enlarged, fragmentary, perspective view of the air treatment and circulating system of the present invention.

Referring now to FIG. 3, the support structure 30 is generally rectangular and of open work construction. While the structure may take various forms and may be constructed of beams or other suitable members having various cross-sectional configurations, in the embodiment illustrated, the structure includes upper and lower pairs of longitudinal members 44 maintained in spaced relation and secured to upper and lower horizontal cross members 46 and vertical corner members 48. Additional bracing may be added as required. The deck 38 is secured to the lower members 44 and 46 thus providing a floor for the unit 28. An intermediate partition 50 extends vertically from the deck 38 to the roof and joins vertically extending, angularly disposed partitions 52, 54 adjacent each end of the support structure 30 and which also form a part of the unit 28.

When the unit 28 is supported by the support frame 26, the partitions 52, 54 at one end of the unit 28 defines a generally triangular-shaped fan motor access room 60 for housing a fan drive motor 31. Fan drive motor 31 is connected in series to fan assemblies 32 by a suitable drive means 35. Fan motor 31 may be sized according to the capacity of the fan assemblies with 3-phase electric motors in the range of 25–40 hp being typical for kilns in the range of 27 to 45 feet wide. Similarly 4 to 6 fan assemblies will be required. Fan motor access room 60 may be utilized as a control room for housing various instruments, valves, controls, mechanisms, etc. for recording various functions. Controls and recorders are schematically illustrated by numeral 62, FIG. 3.

An access door 64 is provided in at least one of the partitions 52 and 54 for providing access to the fan assemblies 32, heat coils 34, etc. A conventional ladder 63 allows access to the fan motor access room 60 without the need for entering the kiln chamber.

Suitable spaced openings 70 are provided in the intermediate partition 50 for receiving the blades 72 of the fan assemblies 32. The fan assemblies 32 may be supported by brackets 74 attached to structure 30. In the embodiment illustrated, preferably four horizontally spaced fan assemblies 32 are provided as a part of the unit 28. The fans are of such size and operate at speeds to move large, uniform volumes of air through the spaced surfaces of the stacks of lumber 80. In the preferred embodiment, each fan is approximately 48" in diameter, has 6 blades, and is rated for 33,000 CFM at 0" static pressure and 1150 RPMs. Thus, the total primary fans capacity is sized at approximately 5 times the empty volume of the kiln.

Mounted upon the structure 30 of the prefabricated unit 28 are brackets 33 for supporting heat exchangers 34, which, in the embodiment illustrated, consists of banks of steam coils as shown by FIGS. 2 and 3. The coils may be of the header or return bend type and are positioned both in front of and behind the fan assemblies to heat the air passing to and/or from the blades 72. Steam is supplied to the coils in a controlled manner by a conventional heating system. However, it is to be understood that various types of heat exchangers may be employed and form a part of the prefabricated unit 28.

Also, an auxiliary humidifier means 36 for increasing the humidity within the chamber 10 during an optional conditioning cycle after the lumber has been dried to correct the "hard case" surface which may occur is mounted upon the structure 30 by suitable brackets 86. Humidifying means 36 also can be used to bring the entire kiln to an equilibrium moisture level prior to drying. As shown, the humidifier means 36 may consist of a generally horizontally disposed steam pipe and have a plurality of small openings therein for spraying moisture into the air as shown by the arrows E, FIG. 2.

Figure 5:
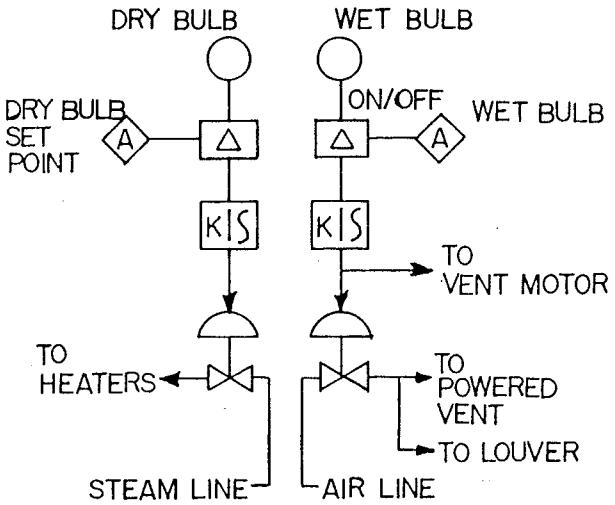
FIG. 5 is a diagramatic view of a control system for a kiln using the present invention.

Projecting through the rear wall 16 and front closure 20 are ventilators 90, 92 which can be selectively opened or closed to regulate the inflow of fresh air into the chamber, through ventilator 90, and the exhaust of humid air but through ventilator 92. Due to this arrangement, the volume of air in circulation at any time is constant due to the fact that any air exhausted through one ventilator is automatically compensated for by an equivalent intake of fresh air through the other ventilator. The ventilator is selectively opened and closed in response to a control signal. An example of such a system is shown in FIG. 5.

Figure 4:
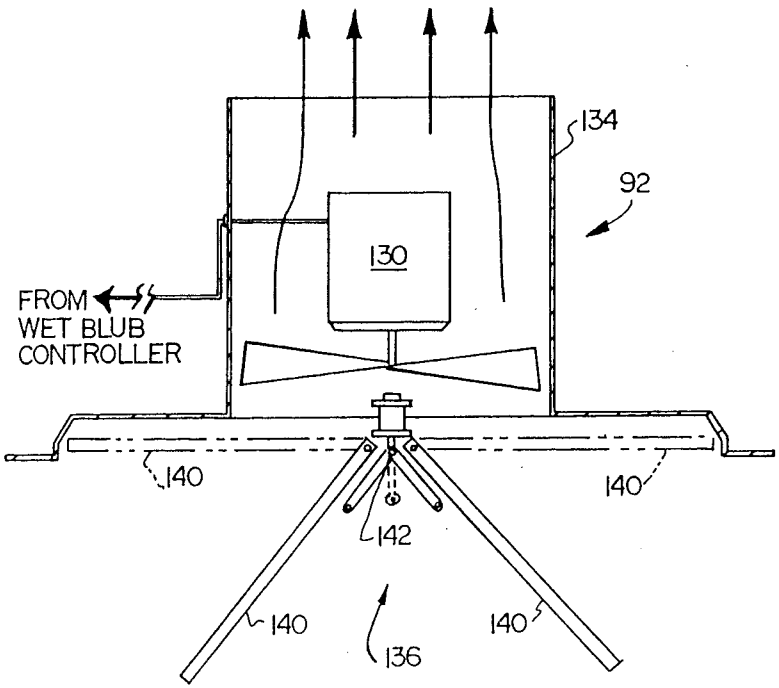
FIG. 4 is an enlarged sectional view of the venting system of FIG. 1 taken along lines 4—4.

As best seen in FIG. 4, exhaust ventilator 92 is powered by a motor 130. Motor 130 is attached to secondary fan 132. Fan 132 is approximately 24" in diameter. Motor 130 is preferably a 1 hp, 3-phase electric motor. Ventilator 92 is rated for 7000 CFM 0" static pressure and 1750 RPM. Additional ventilators 92 are added as the width of the kiln is increased such that the total secondary fan capacity is approximately 50% of the empty volume of the kiln. Thus the secondary fan capacity is at least 5–10% of the primary fan capacity.

Ventilator 90 includes a fan/motor housing 134, approximately 25" in diamater and 24" long which operates to protect motor 130 and channel the exhaust air from the kiln interior. A butterfly damper assembly, generally designated 136, is located in rear wall 16. Damper 136 includes a pair of pivotly mounted plates 140 which are coupled by a suitable arrangement to a double-acting, 1¼" diameter air cylinder 142 having a 3-inch stroke. The cylinder 142 is actuated in response to a control signal from the wet bulb controller, as shown in FIG. 5, by a conventional solenoid operated air valve (not shown). Damper 136 opens approximately 50° when actuated. The dimensions of the damper when closed is 30"×30". In the preferred embodiment, ventilator 92 only comprises a similarly constructed butterfly damper as damper 136 except that its dimensions are 30" wide by 60" high. However, a powered ventilator, similar to ventilator 90, could be used also where additional fan capacity is required.

Attached to the superstructure 30 are baffle plates 40 which facilitate the airflow in a prescribed, efficient manner. During operation of the kiln, the plates are inclined downwardly and outwardly from the sides of the unit 28 such that air is directed by the fan blades in a generally circular path and through the stacks 80 of the lumber, as shown by the arrows in FIG. 2. It is to be understood that periodically the direction of rotation of the fan blades is reversed, and the air would flow in a circular path counter to that illustrated by the arrows of FIG. 2.

Preferably the plates 40 are pivoted upon the lower portions of the structure 30 by hinges 96 or other suitable means. Normally during kiln operation, the ends of the plates opposite the hinges are positioned upon a lumber stack 80. The pivotable mounting of plates 40 is such to permit them to be displaced upwardly to generally vertical positions during transport of the unitized assembly 28 from a prefabricated site to a kiln construction location.

The closure wall assembly 20 of the kiln includes a door consisting of two superposed sections 100, 102 normally aligned in a vertical plane when the kiln is in operation. In the embodiment illustrated, the sections are of generally equal size and are coupled together by a hinge 104. The upper section 100 is pivoted by hinges 106 or other suitable means to a horizontal support beam 105 in such a manner as to permit the section 100 to swing upwardly and outwardly of the kiln to a generally horizontally disposed position, shown by the broken lines in FIG. 2, then the kiln is open. The lower outer extremities of door section 102 are provided with rollers 110 which engage vertical rails 114.

A series of spaced cables 116 are attached adjacent one end by fasteners 118 to the lower ends of door section 102 while opposite ends are secured to the spaced pulleys 120 fixedly mounted for rotation with shaft 122. An operator rotates the shaft 122 in a selected direction by means of a hoist motor 124, reducer 126 and gearing 128. As the shaft is driven to wind the cables 116 upon the pulleys 120, the door section 102 begins to move upwardly as shown by FIG. 1, as the rollers 110 move along rails 114. The hinge 104 permits the adjacent portions of sections 100, 102 to move outwardly and upwardly. In the fully opened condition, the lower section is moved upwardly until sections 100, 102 are generally parallel and generally horizontally extending, as shown by broken lines in FIG. 2. Elongated spools or drums may be substituted for the pulleys 120 if so desired.

The door sections 100, 102 preferably are of similar aluminum construction to that discussed above. Also, the closure assembly 20 is provided with appropriate insulation to seal the chamber. Suitable locking members may be provided to fasten the door sections 100, 102 to the sidewalls, if desired, when the kiln is in operation.

Once the assembly 28 has been properly positioned, the baffle plates are coupled to the shaft 122 by cables or ropes 140, 142. Cable 142 has one end 144 secured to the housing structure adjacent the roof 14. The cable 142 extends around a pulley or guide 146 at the outer end of a plate 40, then upwardly over pulleys 148, 150, and the other end of the cable is attached to a pulley 151 mounted for rotation with shaft 122. Cable 140 has an end portion 152 secured to the housing and extends around pulleys 154, 150. The opposite end is attached to pulley 151. The number of cables, pulleys and baffle plates lifting pulleys secured to shaft 122 may vary depending upon the number and size of the baffle plates 40 utilized.

Upon rotation of the shaft 122 in a first direction, the cables 116 lift the door sections 100, 102 to open the kiln. Simultaneously with the rotation of shaft 122 cables 144, 142 are wound upon a pulley or pulleys 151 to pivot the outer end portions of the plates 40, 40 upwardly to out-of-the-way positions. With the plates in their upward positions stacks of lumber can be readily moved in or out of the kiln chamber. When the door sections 100, 102 are closed, the plates 40, 40 also are lowered to positions resting upon upper portions of stacks of lumber.

In operation, the sections 100, 102 are lifted to the dotted line position, FIG. 2, the plates 40, 40 are pivoted upwardly, and stacks of lumber 80 are positioned within the chamber 10. The shaft 122 is rotated to lower and close the door sections and lower the plates 40, and the fan assemblies are activated for causing a continuous recirculation of air in a prescribed direction through the chamber and stacked lumber. Steam may be directed to the coils 34, and moisture may be sprayed into the air by humidifier pipe 36. The condition of the treated air circulating through the lumber stacks can be varied optionally by suitable regulating devices to achieve the desired drying effects. The ventilators 90, 92 are then selectively opened or closed to obtain the desired wet bulb conditions.

The conditioned or treated air flows horizontally through the lumber stacks. Since that portion of the stack which the air first enters will dry more rapidly than the opposite side of the lumber stacks, the direction of rotation of the fans and the direction of flow of the treated air are periodically reversed. Leaving the fan blades 72, the air is forced through the heating coils 34 and past the humidifiers 36 at one side of assembly 28, and is directed by a baffle plate 40 to the outer side of a stack of lumber. The conditioned air then moves through the spaced, stacked lumber, and as it exits the last stack moves upwardly over another baffle plate and to a bank of heating coils and thence back to the fan blades.

Certain modifications and improvements will occur to those skilled in the art upon reading the foregoing description. By way of example, modulated flow dampers could be substituted for the open/closed butterfly dampers. Furthermore, the airflow direction of exhaust ventilator 92 could be revered, depending on the airflow direction of the primary fans, thereby increasing total kiln efficiency.

It should be understood that all such modifications and improvements have been deleted herein for the sake of conciseness and readability but are properly within the scope of the following claims.

I claim:

1. A kiln for seasoning lumber, comprising:

(a) a housing defining a drying chamber and having opposed side walls;

(b) a top wall forming a roof;

(c) an end wall;

(d) closure means opposite said end wall for permitting lumber to be inserted within and removed from said chamber;

(e) an air treatment and circulating assembly adjacent said top wall, said air treatment and circulating assembly including a series of fan assemblies for circulating air to the lumber stacked within said chamber and means for heating air within said chamber;

(f) a power-operated exhaust venting system located on the downstream side of the airflow from the lumber stack and on the upstream side of said air treatment and circulating assembly, said exhaust venting system being operable to exhaust moisture-laden wet air prior to the air passing through said air treatment and circulating system; and (g) an intake air vent located downstream of the air flow from said air treatment and circulating assembly and upstream of the stacked lumber, said air vent being operable to add additional outside air to make up that portion of air which is exhausted through said exhaust venting system, whereby the flow of air circulated through the lumber stacked within said chamber remains substantially constant, wherein said air treatment and circulating assembly and said power-operated venting system are reversible, whereby said power-operated venting system is operable to add additional outside air and said air vent is operable to exhaust the moisture-laden air prior to the air passing through said air treatment and circulating assembly.

2. The apparatus according to claim 1, wherein said air treatment and circulating assembly includes a framework having baffle plates pivotably mounted thereon for displacement between a lowered position and a generally vertically disposed raised position opposite said heating means, said baffle plates directing circulating air in a prescribed manner.

* * * * *